US005966748A

United States Patent [19]

Young et al.

[11] Patent Number: 5,966,748

[45] Date of Patent: Oct. 19, 1999

[54] TINKLE SAFE

[76] Inventors: Edward J. Young; Virginia Young, both of 220 Rock Ford Rd., Waco, Tex. 76712

[21] Appl. No.: 09/070,921

[22] Filed: May 4, 1998

[51] Int. Cl.[6] ..... A47K 11/00

[52] U.S. Cl. ..... 4/144.4

[58] Field of Search ..... 4/144.1–144.4

[56] References Cited

U.S. PATENT DOCUMENTS

| | | | |
|---|---|---|---|
| 4,023,216 | 5/1977 | Li | 4/144.3 |
| 4,756,029 | 7/1988 | Zieve et al. | 4/144.4 |
| 4,857,064 | 8/1989 | Mendoza | 4/144.2 X |
| 4,937,889 | 7/1990 | Strickland . | |
| 5,330,453 | 7/1994 | Cornellier . | |
| 5,333,330 | 8/1994 | Murtagh . | |
| 5,370,637 | 12/1994 | Brodeur | 4/144.3 X |
| 5,408,703 | 4/1995 | Cicio . | |

*Primary Examiner*—Charles E. Phillips
*Attorney, Agent, or Firm*—Joseph H. McGlynn

[57] ABSTRACT

A female urination device which allows a female to urinate from a standing position and is a funnel shaped device with an opening at one end that is contoured to the shape of the female body and a second end which is smaller than the first end and has an opening to funnel the urine away from the user. In addition, the first end has a sanitary wiping pad attached thereto.

5 Claims, 1 Drawing Sheet

TINKLE SAFE

BACKGROUND OF THE INVENTION

This invention relates, in general, to female urination devices, and, in particular, to female urination devices which allow a female to urinate in a standing position.

DESCRIPTION OF THE PRIOR ART

In the prior art various types of female urination devices have been proposed. For example, U.S. Pat. No. 4,937,889 to Strickland discloses a female urinal which has an outwardly slanting wall at one end and other walls which have indentations permitting easy hand gripping of the urinal.

U.S. Pat. No. 5,330,453 to Cornellier discloses a female urination device made as a one piece body of biodegradable cellulose which is V-shaped to allow easy folding of the device.

U.S. Pat. No. 5,333,330 to Murtagh discloses a female urination device which is a funnel shaped device which folds from a flat condition into a tubular shape.

U.S. Pat. No. 5,408,703 to Cicio discloses a female urination device having a first end with a contoured opening and a second end for discharging the urine.

SUMMARY OF THE INVENTION

The present invention is directed to a female urination device which allows a female to urinate from a standing position and is a funnel shaped device with an opening at one end that is contoured to the shape of the female body and a second end which is smaller than the first end and has an opening to funnel the urine away from the user. In addition, the first end has a sanitary wiping pad attached thereto.

It is an object of the present invention to provide a female urination device which is simple, easy to manufacture and convenient to carry.

It is an object of the present invention to provide a female urination device which has a sanitary wiping pad at one end.

These and other objects and advantages of the present invention will be fully apparent from the following description, when taken in connection with the annexed drawings.

DESCRIPTION OF THE PREFERRED EMBODIMENT

Figure 1:
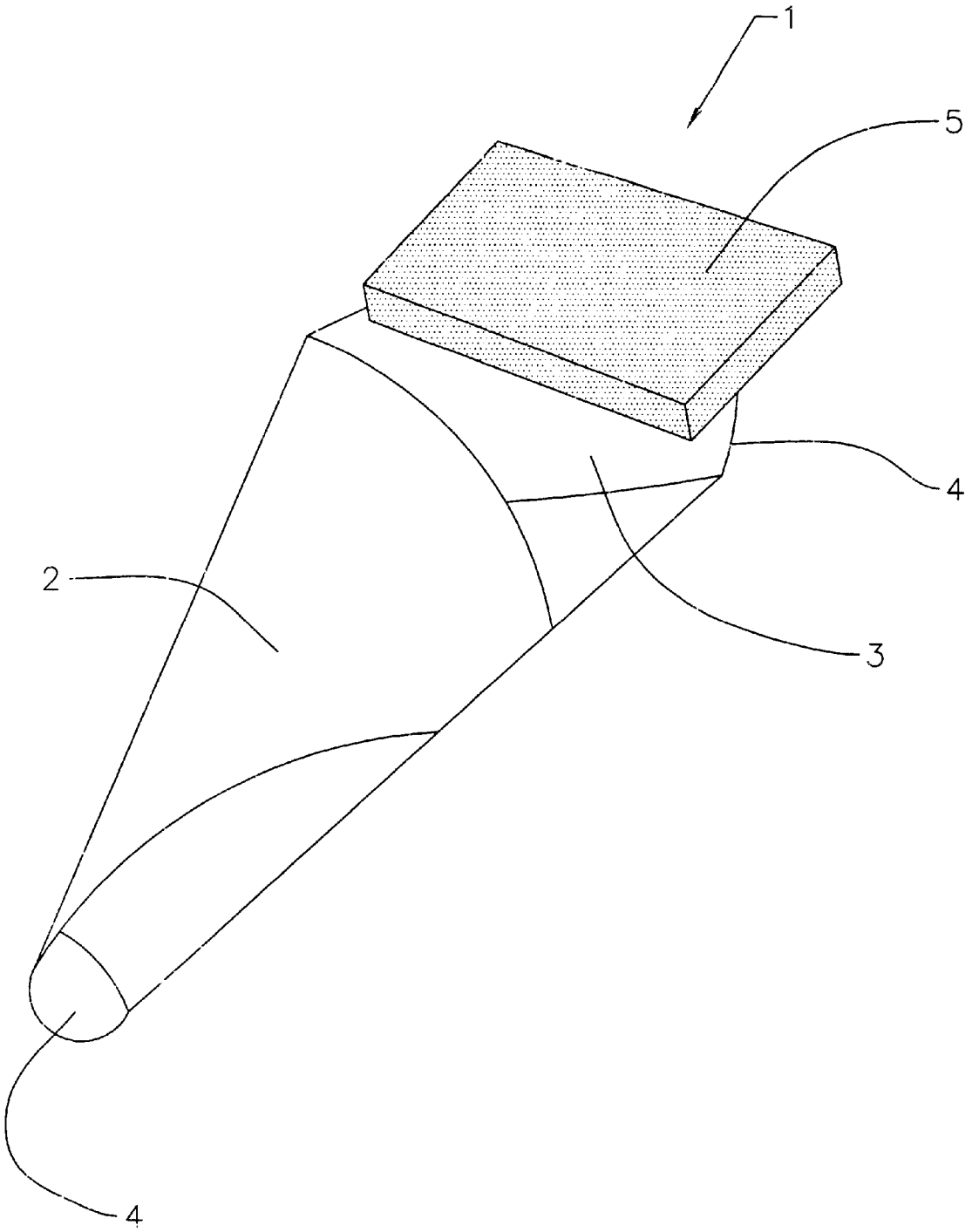
FIG. 1 is a perspective view of the present invention.

Referring now to the drawings in greater detail, FIG. 1 shows the present invention 1. The present invention is designed to assist a female to urinate from a standing position. In many types of activities such, as camping trips in remote areas, public facilities are not available. In addition, even where public facilities are available, a female might feel that they are not sanitary enough to use. In these cases a device which the female can use from a standing position would be beneficial.

The present device 1 is a flat sheet of material that can be wrapped by the user to form a funnel shaped device 2, or can be pre-wrapped or pre-formed. Since the device is flat it can be conveniently carried in a purse or pocketbook, and, therefore, be available at all times. The material of the device should be made from a biodegradable material such as paper, although other materials may be selected without departing from the scope of the invention.

When wrapped the device will assume a funnel shape as shown in FIG. 1. One end of the device will have a large opening 3 and a flap 4 which is contoured to fit around the outside of the female's vulva. The other end of the device will have a smaller opening 4 which will allow the urine to exit the device and be directed away from the user.

In addition, the end of the device with the larger opening will have a sanitary wiping pad 5 attached thereto. The sanitary wiping pad 5 should be made from an absorbent material that is also biodegradable similar to the material that disposable diapers are made from. As shown in FIG. 1, the sanitary pad 5 is attached to the flap 4 so that a portion of the pad extends beyond the edge of the flap 4. In this way, when a female is using the device, the pad is positioned behind the opening of the vulva and will not be contaminated with urine. Also, when the female is finished urinating, the pad is in the proper position so the female can wipe from the back to the front, thereby avoiding spreading any urine toward the rear of her body.

In addition, since the pad 5 extends beyond the upper flap 4, the overhang provides a convenient gripping portion, for the female to use during the wiping portion, that is not contaminated with urine. Therefore, if the device is used where there are no washing facilities, the female will not contaminate her hands during the wiping operation. Also, the pad 5 will provide a cushion between the female's body and the material of the device that might otherwise be uncomfortable and irritating to the user's body.

Once the user is finished, she may dispose of the device in any conventional manner. Since all parts of the device are biodegradable, disposal of the device will have no adverse environmental effects.

Although the Tinkle Safe and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A disposable device for assisting a female in urinating from a standing position and for directing the urine a suitable distance away from the female, said device comprising:

a first end having an opening for receiving urine, a second end having an opening for discharging said urine, said opening in said first end being larger than said opening in said second end, said first end having a flap adjacent said opening in said first end, said flap extending away from said opening in said first end, a pad attached to said flap, and wherein said flap has an edge which is remote from said opening in said first end, and said pad has a length, width and a thickness, said width of said pad extending beyond said edge of said flap.

2. The disposable device for assisting a female in urinating as claimed in claim 1, wherein said device is made from a biodegradable material.

3. The disposable device for assisting a female in urinating as claimed in claim 1, wherein said device is funnel shaped.

4. The disposable device for assisting a female in urinating as claimed in claim 1, wherein said pad is made from a material that is softer than a material that said device is made from.

5. The disposable device for assisting a female in urinating as claimed in claim 1, wherein said pad is made from an absorbent material.

* * * * *